US007264552B2

(12) United States Patent
Chen

(10) Patent No.: US 7,264,552 B2
(45) Date of Patent: Sep. 4, 2007

(54) MOVEABLE GUTTER FOR BOWLING LANES HAVING ILLUMINATION SOURCES

(76) Inventor: Rong Chen, #888 San Zao Industrial Park, Nan Hui, Shanghai (CN) 201300

( * ) Notice: Subject to any disclaimer, the term of this patent is extended or adjusted under 35 U.S.C. 154(b) by 0 days.

(21) Appl. No.: 10/876,369

(22) Filed: Jun. 23, 2004

(65) Prior Publication Data

US 2005/0288117 A1 Dec. 29, 2005

(51) Int. Cl.
*A63B 67/00* (2006.01)

(52) U.S. Cl. ..... 473/54; 473/113

(58) Field of Classification Search ..... 473/54, 473/113, 115; 362/84, 477, 576, 806
See application file for complete search history.

(56) References Cited

U.S. PATENT DOCUMENTS

| | | | | |
|---|---|---|---|---|
| 3,401,933 | A * | 9/1968 | Conklin et al. | 473/109 |
| 3,551,723 | A * | 12/1970 | Van Groningen | 313/250 |
| 3,761,086 | A | 9/1973 | Miller | 273/47 |
| 4,801,143 | A | 1/1989 | Heddon | 273/51 |
| 4,913,433 | A | 4/1990 | Rochefort | 373/51 |
| 4,998,391 | A * | 3/1991 | Connew | 52/179 |
| 5,415,591 | A * | 5/1995 | Beene | 473/113 |
| 5,584,766 | A * | 12/1996 | File | 473/54 |
| 5,800,274 | A | 9/1998 | Widrick et al. | 473/54 |
| 6,031,343 | A | 2/2000 | Recknagel et al. | 315/292 |
| 6,340,335 | B1 | 1/2002 | Recknagel | 473/54 |
| 6,402,629 | B1 | 6/2002 | Heddon | 473/55 |
| 6,712,713 | B1 * | 3/2004 | Lundgren | 473/115 |
| 6,742,916 | B1 * | 6/2004 | Dunn | 362/477 |
| 2002/0127430 | A1 | 9/2002 | Nelson et al. | 428/690 |
| 2003/0060299 | A1 | 3/2003 | Perrier et al. | 473/115 |
| 2004/0171430 | A1 * | 9/2004 | Perrier et al. | 473/115 |

* cited by examiner

*Primary Examiner*—William M. Pierce

(57) ABSTRACT

A moveable gutter for a bowling lane is disclosed. The gutter includes a bumper surface that functions as a bumper when said inner edge is raised from a lower position to a fixed upper position higher than the adjacent lane surface. One or more illumination sources may be disposed along the surface of the gutter and bumper surface. A portion of said bumper surface is approximately parallel with the surface of a bowling ball on the bowling lane when the upper surface is in the upper position.

8 Claims, 4 Drawing Sheets

MOVEABLE GUTTER FOR BOWLING LANES HAVING ILLUMINATION SOURCES

BACKGROUND

1. Field of the Disclosure

The disclosure relates generally to a bumper apparatus for bowling lanes, and in particular, to a convertible gutter apparatus that functions both as a gutter in a lower position and a bumper in a upper position, and includes illumination sources disposed about the gutter and bumper surfaces.

2. The Prior Art

Background

Bowling is a popular game, attracting millions of participants to bowling alleys each year. To promote bowling to a wider audience, bowling alley operators desire to market bowling to children. However, children and other groups may have trouble throwing a bowling ball successfully down the alley, resulting in the frustration of having the ball fall into the gutter.

To prevent a bowling ball from falling into the gutter, bumpers may be installed to direct the ball back into the lane and ultimately to the pins. However, bumpers of the prior art often require personnel to manually install or raise the bumpers, or comprise upright gates that may be raised to function as bumpers. Such prior bumpers may not direct the ball back into the lane in a consistent and predictable manner, or may be unable to withstand the impact from a harder thrown ball.

BRIEF DESCRIPTION OF THE DRAWING FIGURES

DETAILED DESCRIPTION

Figure 1:
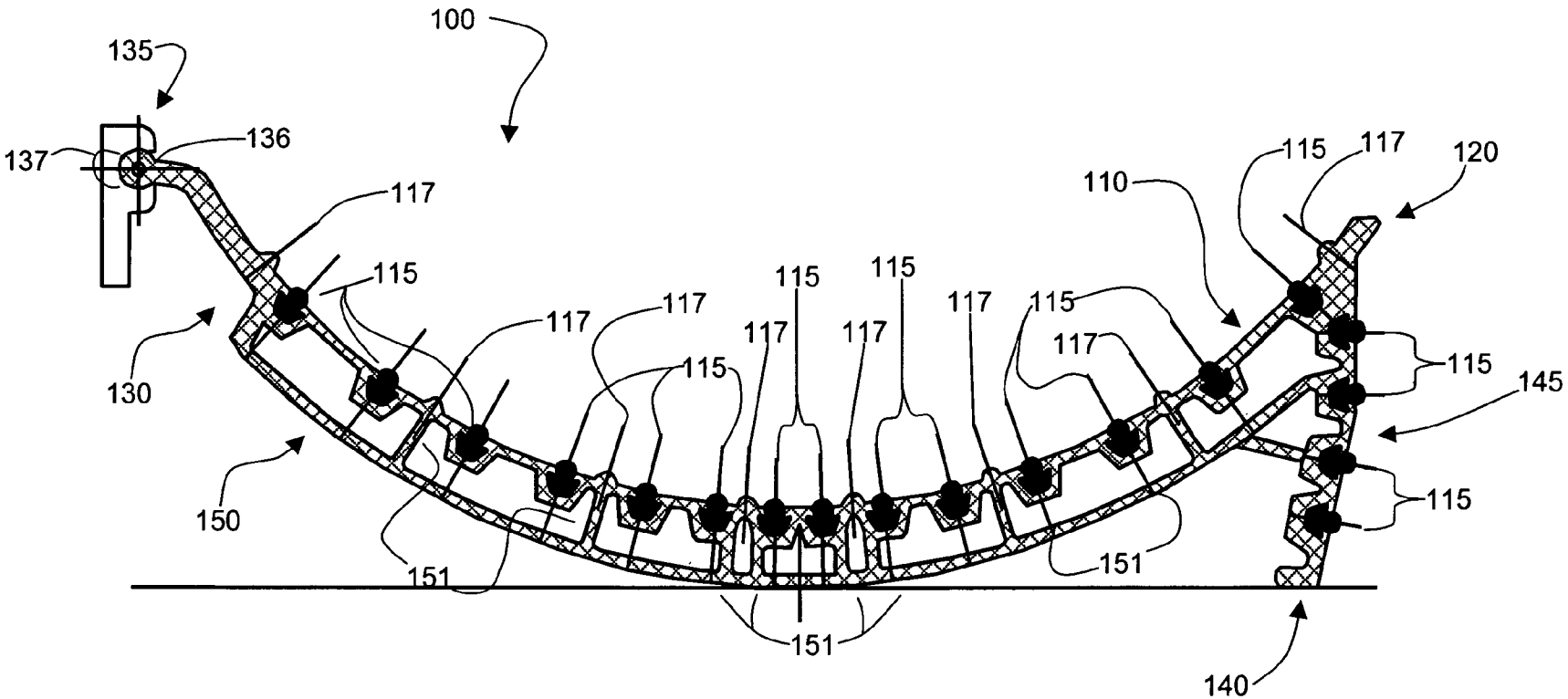
FIG. 1 is a cross-sectional diagram of a moveable gutter configured in accordance with the teachings of this disclosure, showing illumination sources disposed about the gutter and bumper surfaces.

Persons of ordinary skill in the art will realize that the following description is illustrative only and not in any way limiting. Other modifications and improvements will readily suggest themselves to such skilled persons having the benefit of this disclosure. In the following description, like reference numerals refer to like elements throughout.

A bowling lane configured in accordance with the teachings of this disclosure includes a bumper disposed on each side of the lane for preventing the ball from rolling into the gutters, and will assure that at least one of the two balls thrown in each frame of the game will hit the pins, thus maintaining the children's interest in bowling.

FIG. 1 is a cross-sectional diagram of a moveable bowling alley gutter 100 configured in accordance with the teachings of this disclosure. The gutter 100 includes a concave upper gutter surface 110 that serves as the gutter for an adjacent bowling lane. The gutter 100 may be defined as having an inner edge 120 which is adjacent to the lane for which the gutter serves, and an outer edge 130 distal from the lane.

The inner edge 120 of gutter 100 further includes a bumper 140 having an inner-facing bumper surface 145 that functions as a bumper when the inner edge 120 is raised to a position higher than the adjacent lane surface. To facilitate the raising and lowering of the gutter 100, the outer edge 130 is rotatably mounted to a support fixture 135 that allows it to pivot, as shown in FIG. 1. The outer edge 130 of the gutter may be attached to the support structure 135 using a tongue-and-groove arrangement, whereby a tongue 136 is formed in the outer edge 130, and a groove 137 is formed in the support structure 135. The support structure 135 may be part of the host lane's support structure, and the groove 137 may extend or partially the length of the lane, parallel with the lane surface.

The gutter 100 may further include a back support surface 150 for providing additional strength and rigidity to the gutter. The back surface 150 may be coupled to the upper gutter surface 110 through one or more cross members 151.

To improve both the function and decorative appearance of the gutters and caps along the side of bowling lanes, the gutter 100 may include one or more illumination sources 115. In a preferred embodiment, the illumination sources may comprise a series of raised strips disposed longitudinally about the upper surface 110 of the gutter 100. The illumination sources 115 may comprise materials that glow in the dark when exposed to ultraviolet light, or may comprise a self-illuminating fluorescent material.

The gutter 100 may be formed with reverse tapered grooves running lengthwise along the upper surface 110 of the gutter. The illumination strips are preferably formed in a cross-sectional shape corresponding to the grooves in which they are installed, thus fitting snugly into the reverse taper grooves of the gutter. The shape of the grooves is such that the strips will not become detached in use, but may be removed and replaced by personnel as need.

The upper surface of the strips preferably includes a rounded cross sectional shape extending slightly above the surface of the gutter, thereby forming longitudinal ridges along the length of the gutter. The upper surface 110 may also include ridges 117 formed directly in the upper surface as well. Balls rolling in the gutter will therefore contact only the rounded surface of these ridges 117, and thus reduce rolling friction, wear, and damage to the balls.

It is contemplated that the bumper surface 145 may also include illumination sources 115 disposed in the bumper surface 145 that are viewable when the inner edge 120 is raised above the lane surface.

As will be appreciated, the illumination sources add an attractive decorative feature to the gutters, which are typically black in color. It is contemplated that the illumination sources may comprise electrical lights as well.

Figure 2B:
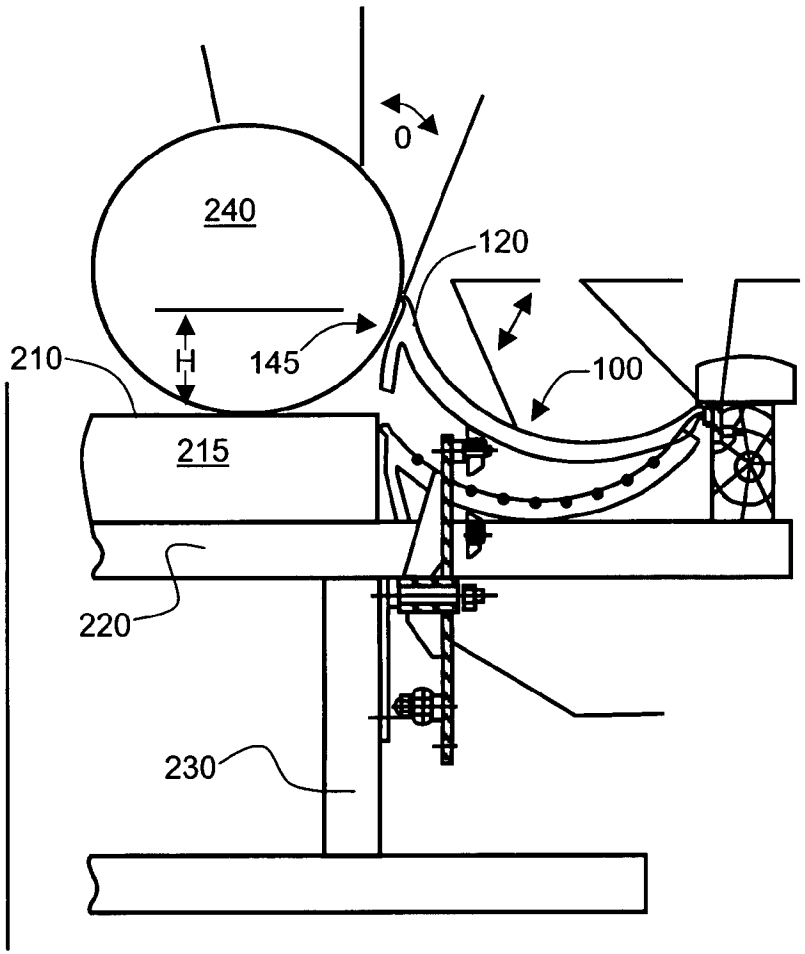
FIGS. 2A-2B are cross-sectional diagrams of a moveable gutter deployed in a bowling alley and configured in accordance with the teachings of this disclosure.
Figure 2A:
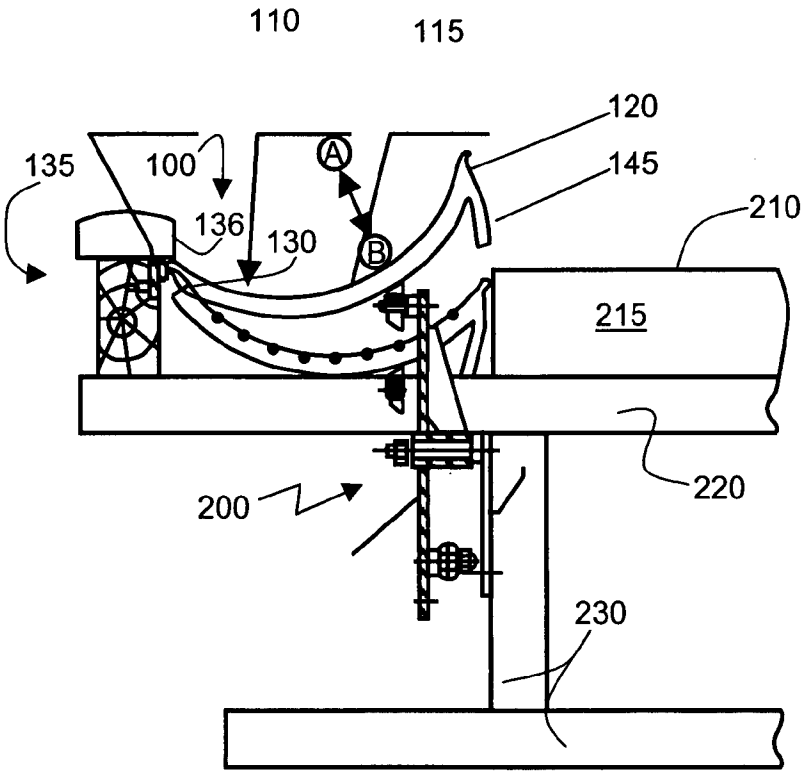

Referring to FIGS. 2A and 2B, cross sectional diagrams are shown of the gutter 100 in use in a bowling alley. FIGS. 2A and 2B show a bowling lane 215 having a playing surface 210 disposed on a base 220 over the underlying support structure 230. The gutter 100 is shown having an outer edge 130 rotatably mounted in the support structure 135 as described above. The gutter 100 may include one or more illumination sources 115.

Referring first to FIG. 2A, the gutter 100 is shown in two positions, a raised position A and a lower position B. As will be appreciated from FIG. 2A, when the gutter is in the lower position B, it functions as a typical bowling lane gutter with the inner edge 120 resting proximate to the lane surface 210.

However, when the gutter is in the raised position A, the bumper surface 145 is exposed, and forming a bumper for the adjacent lane. To facilitate the automated raising and lowering of the gutter, a pivoting lifter arm mechanism 200 is provided as will be described below.

Referring to FIG. 2B, a bowling ball 240 is shown adjacent to the bumper surface 145 of the gutter 100. As can be seen from FIG. 2B, a portion of the bumper surface 145 is aligned at an angle θ when the inner edge 120 is raised to a height H. The angle and height are preferably chosen such that a portion of the bumper surface 145 is relatively parallel to the outer surface of the bowling ball, thus presenting a solid bumper surface to the ball, and preventing the ball from bouncing over the bumper.

Thus, the moveable gutter of this disclosure may be described as having an outer edge rotatably mounted to a support fixture of the bowling lane such that the bumper surface functions as a bumper when the inner edge is raised from a lower position to a fixed upper position higher than the adjacent lane surface, resulting in a portion of the bumper surface being approximately parallel with the surface of a bowling ball resting on the bowling lane when the upper surface is in the upper fixed position.

Figure 3:
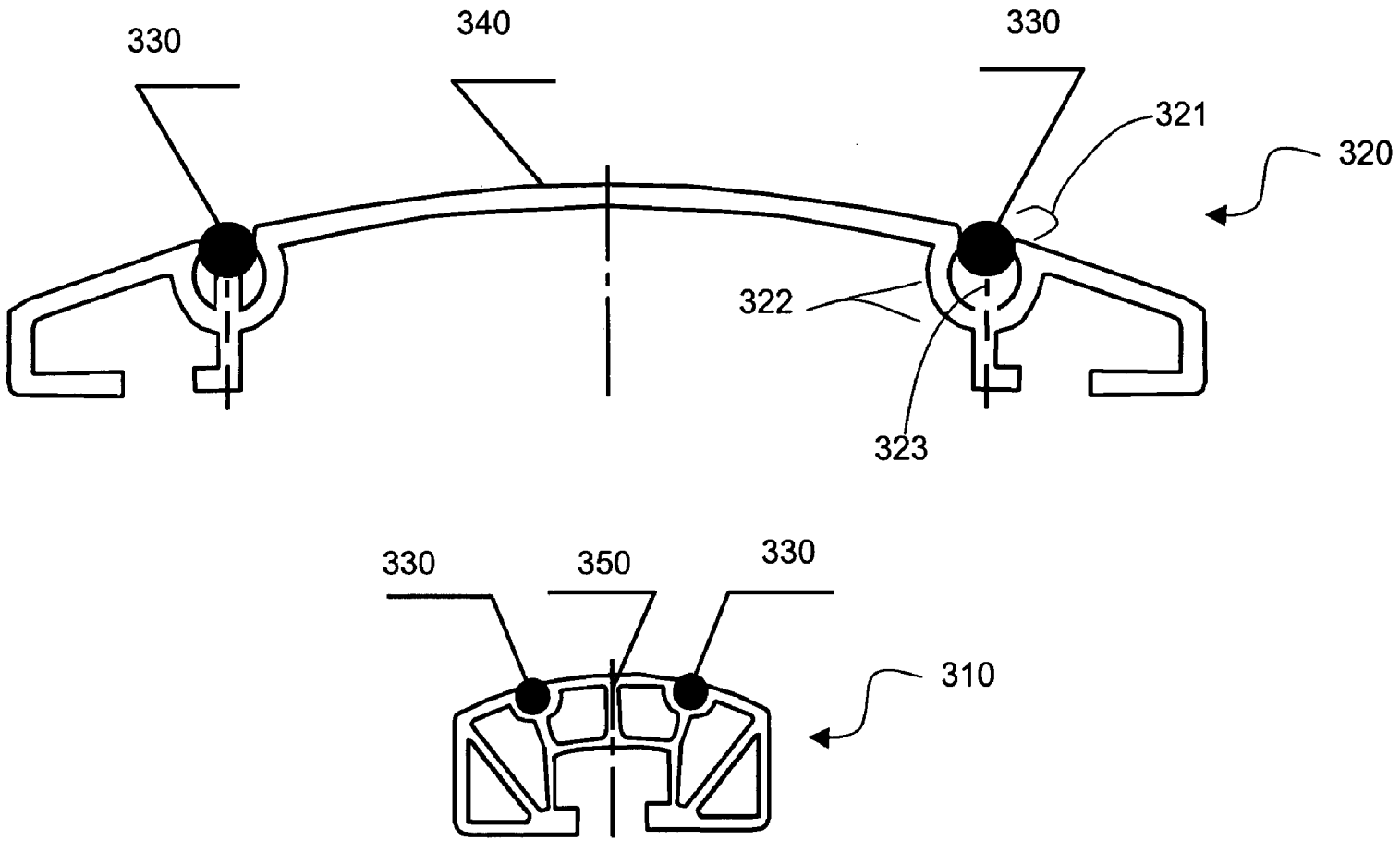
FIG. 3 is a cross-sectional diagram of a bowling alley caps configured in accordance with the teachings of this disclosure.

Referring now to FIG. 3, cross sections of bowling lane caps 310 and 320 are shown. Cap 310 may comprise the type typically used to cap the gutter support, and cap 320 may comprise a center cap typically used to cover the ball return between lanes. Illumination strips 330 may be disposed in the surfaces 340 and 350 of caps 320 and 310, respectively. FIG. 3 shows that the illuminations sources may also comprise a rounded shape.

The sources may be disposed in grooves 322 configured to received and removably hold the sources 330. The grooves may comprise a generally round shape having a width slightly less than the diameter of the illumination source to be received, resulting in the upper edge 321 pinching and thus retaining the source 300. The groove 322 may include a support member 323 to provide support for the source and properly align the source with the upper edge 321.

Figure 4:
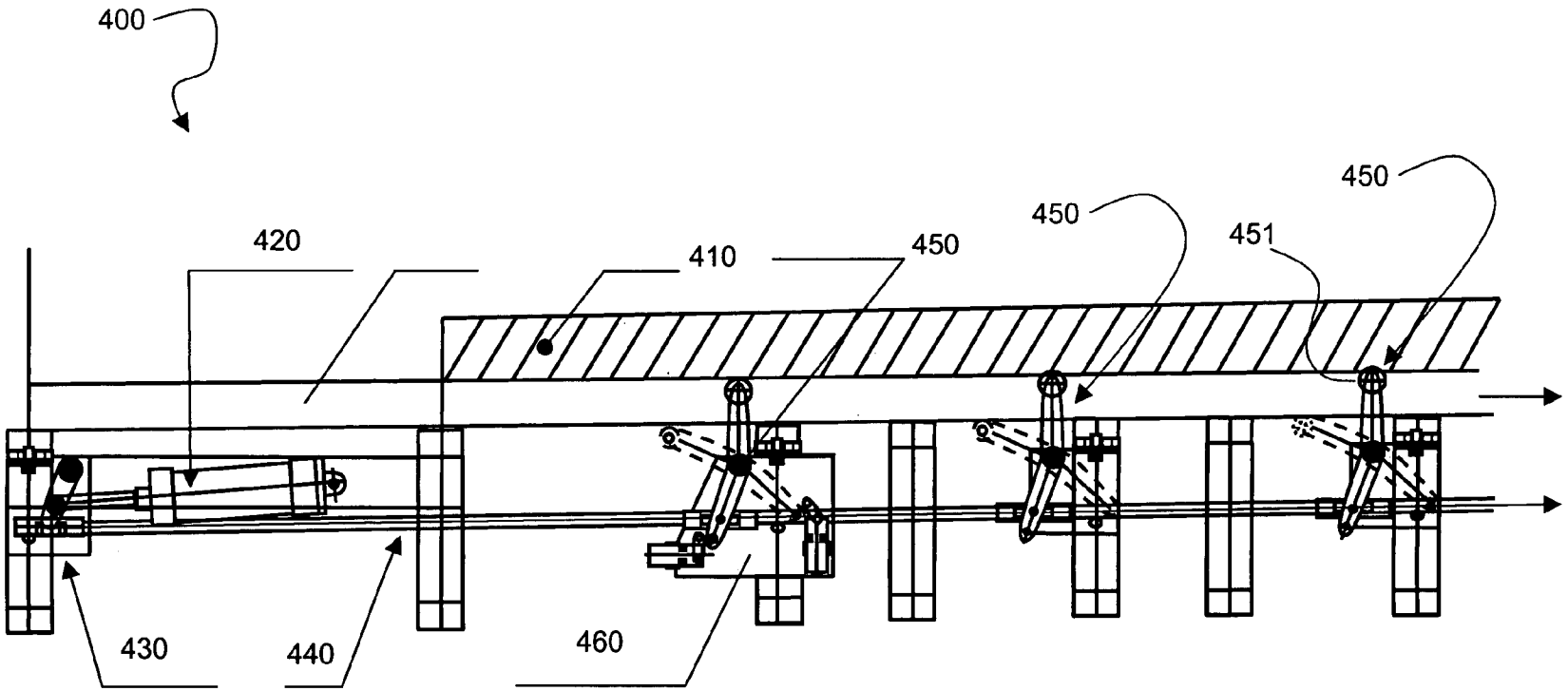
FIG. 4 is a diagram of apparatus for moving a gutter configured in accordance with the teachings of this disclosure.

FIG. 4 is a side cross sectional view of moveable gutter system 400. The system consists of the moveable gutter 410, a hydraulic cylinder or motor 420, an actuator arm 430, a connecting rod 440, passive actuator arms 450, and an on/off limiting switch 460.

To raise and lower the gutter, force is provided from the hydraulic cylinder or motor 420, which is connected to an actuating lever 430. The lever 430 is turn connected to a rod that runs under the gutter and is pulled or pushed by the lever 430.

The rod 440 is connected to the bottom end of a series of pivoting lifter arms 450 such that when the lever is pulled it will raise the top ends of the of pivoting lifter arms from a lower position to a highest position. When pushed back, the rod 440 will lower the pivoting lifter arms back to their lowest positions.

The top ends of the of pivoting lifter arms rest against the lower surface of the free side of the pivoting gutter, thus raising or lowering it with their motion. To minimize friction due to the sliding of the arms along the under surface of the gutter, it is contemplated that the arms may be fitted with a small wheel 451.

In a preferred embodiment, the portion of the gutter from the foul line to a point approximately 600 mm from the foul line will be fixed in position, while the moveable portion of the gutter of this disclosure will extend from the 600 mm point to the end of the lane (i.e. to the beginning of the pin deck). The portion then continues as a fixed gutter. The length of the fixed and moveable gutter may be approximately 17.67 m, or a length determined by bowling standards. When the moveable portion of the gutter is lowered it will function as part of a standard gutter of standard function and dimensions.

The on/off limiting switch system 460 may comprise two switches positioned on the mounting bracket of the first of pivoting lifter arm 450. The position of the switches may be adjusted to achieve the desired raised and lowered position of the gutter, and to align the bumper surface at a desired angle and height.

The series of pivoting lifter arms 450 can be adjusted so that the position and movement of all of the arms will be coordinated. It is contemplated that any number of pivoting lifter arms may be used; in one preferred embodiment 12 sets of pivoting lifter arms are provided under each gutter.

It will be appreciated that other lifting mechanisms may be employed, such hydraulic or piston-driven lifting means.

While embodiments and applications of this disclosure have been shown and described, it would be apparent to those skilled in the art that many more modifications and improvements than mentioned above are possible without departing from the inventive concepts herein. The disclosure, therefore, is not to be restricted except in the spirit of the appended claims.

What is claimed is:

1. A moveable gutter with illumination sources comprising:

a gutter having a concave upper gutter surface, said upper surface having an inner edge adjacent to the bowling lane and an outer edge distal from the bowling lane;

said inner edge of said gutter surface comprising a bumper and said outer edge being rotatably mounted such that said gutter may be raised from a lower position to a fixed upper position higher than the adjacent lane surface;

at least one illumination source disposed longitudinally about said upper surface, wherein said at least one illumination source comprises a self-illuminating fluorescent material that glows in the dark when exposed to light, said at least one illumination source is disposed within reverse tapered grooves running lengthwise along said upper surface, said at least one illumination source is formed in a cross-sectional shape corresponding to said tapered grooves, and the upper surface of said at least one illumination source comprises a rounded cross sectional shape extending slightly above the surface of the gutter, thereby forming longitudinal ridges along the length of the gutter; and a plurality of gutter ridges formed directly in said upper surface, each of said plurality of gutter ridges having a rounded surface, wherein a bowling ball rolling in the gutter contacts only the rounded surface of said plurality of gutter ridges when said gutter is in said lower position.

2. The moveable gutter of claim 1, wherein said bumper comprises at least one illumination source, such that said illumination source is viewable when said inner edge is in said upper position.

3. The moveable gutter of claim 2, wherein said at least one illumination source may be removably installed in said tapered groove.

4. The moveable gutter of claim 2, wherein a portion of said bumper surface is approximately parallel with the surface of a bowling ball on said bowling lane when said upper surface is in said upper position.

5. A moveable gutter for a bowling lane comprising:

moveable gutter means having a concave upper gutter surface, said upper surface having an inner edge adjacent to the bowling lane and an outer edge distal from the bowling lane;

said inner edge of said gutter surface further comprising bumper means;

means for rotating said moveable gutter means from a lower position to a fixed upper position higher than the adjacent lane surface; and illumination means disposed about said upper surface, wherein said illumination means comprises a self-illuminating fluorescent material that glows in the dark when exposed to light, said illumination means is disposed within reverse tapered grooves running lengthwise along said upper surface, said illumination means is formed in a cross-sectional shape corresponding to said tapered grooves, and the upper surface of said illumination means comprises rounded cross sectional shape extending slightly above the surface of the gutter, thereby forming longitudinal ridges along the length of the gutter; and a plurality of gutter ridges formed directly in said upper surface, each of said plurality of gutter ridges having a rounded surface, wherein a bowling ball rolling in the moveable gutter means contacts only the rounded surface of said plurality of gutter ridges when said moveable gutter means is in said lower position.

6. The moveable gutter of claim 5, wherein said bumper comprises illumination means, such that said illumination source is viewable when said inner edge is in said upper position.

7. The moveable gutter of claim 6, wherein said illumination means may be removably installed in said tapered groove.

8. The moveable gutter of claim 6, wherein a portion of said bumper means comprises a surface approximately parallel with the surface of a bowling ball on said bowling lane when said upper surface is in said upper position.

* * * * *